United States Patent [19]

Knoble et al.

[11] 4,051,411

[45] Sept. 27, 1977

[54] DISCHARGE LAMP OPERATING CIRCUIT

[75] Inventors: David W. Knoble, East Flat Rock; Don Morais, Hendersonville, both of N.C.

[73] Assignee: General Electric Company, New York, N.Y.

[21] Appl. No.: 719,764

[22] Filed: Sept. 2, 1976

[51] Int. Cl.[2] ..... H05B 41/34

[52] U.S. Cl. ..... 315/205; 315/206; 315/208; 315/219; 315/226; 315/290; 315/246; 315/DIG. 7

[58] Field of Search ..... 315/205, 206, 208, 219, 315/226, 290, 246

[56] References Cited

U.S. PATENT DOCUMENTS

| | | | |
|---|---|---|---|
| 3,265,930 | 8/1966 | Powell | 315/290 X |
| 3,890,537 | 6/1975 | Park et al. | 315/208 |

*Primary Examiner*—Alfred E. Smith
*Assistant Examiner*—Charles F. Roberts
*Attorney, Agent, or Firm*—Sidney Greenberg

[57] ABSTRACT

Color properties of high pressure sodium vapor discharge lamps are improved by disclosed operating circuit for applying pulsed direct current to the lamp. The circuit comprises a direct current supply circuit, a transistor switch in series with a ballast inductor and a lamp across the supply circuit, an SCR switch connected across the inductor, a coasting diode across the inductor and lamp, and a control circuit connected to the switches for applying DC pulses to the lamp at a predetermined repetition rate and duty cycle. The circuit produces pulse waveforms which provide optimum color improvement in the lamp and makes efficient use of the energy supplied from the power source.

16 Claims, 4 Drawing Figures

DISCHARGE LAMP OPERATING CIRCUIT

The present invention relates to discharge lamp operating circuits, and more particularly concerns direct current operating circuits for such lamps.

It is an object of the invention to provide an improved direct current operating circuit for applying direct current pulses on gaseous discharge lamps, especially of high pressure sodium vapor type, to produce improved color properties of the lamp.

It is a particular object of the invention to provide a circuit of the above type which produces current waveforms of rapid rise and fall for effecting marked increase in the color temperature of high pressure sodium vapor lamps.

Other objects and advantages will become apparent from the following description and the appended claims.

With the above objects in view, the present invention in one of its aspects relates to a lamp operating circuit comprising, in combination, a direct current power source, first controlled switch means, inductance means and a gaseous discharge lamp connected in series across the power source, diode means connected across the series connected inductance means and gaseous discharge lamp, second controlled switch means connected to the inductance means, and control means connected to the first and second controlled switch means for repetitively and sequentially operating the same at predetermined intervals, whereby DC pulses are applied to the gaseous discharge lamp for operation thereof.

In one embodiment of the invention, the inductance means is an induction coil connected in series between the first controlled switch means and the lamp, with the second controlled switch means being connected across the induction coil. In another embodiment, the inductance means comprises a transformer having a primary winding in series with the lamp and a secondary winding magnetically coupled thereto, the second controlled switch means being connected across the secondary winding.

The operating circuit of the invention may be used for applying DC pulses of predetermined duty cycle and repetition rate on the lamp for improving the color and other properties thereof. A method and apparatus for pulsed operation of high pressure sodium vapor lamps for improving the color rendition of such lamps are disclosed in co-pending application Ser. No. 649,900 - Osteen, filed Jan. 16, 1976 and assigned to the same assignee as the present invention.

As disclosed in the Osteen application, the high pressure sodium vapor lamp typically has an elongated arc tube containing a filling of xenon at a pressure of about 30 torr as a starting gas and a charge of 25 milligrams of amalgam of 25 weight percent sodium and 75 weight percent mercury.

The present invention provides an improved circuit for DC pulsed operation of such lamps in accordance with the method and principles disclosed in the copending Osteen application, and the disclosure thereof in that application is accordingly incorporated herein by reference. As there disclosed, pulses may be applied to the lamp having repetition rates above 500 to about 2,000 Hertz and duty cycles from 10% to 30%. By such operation, the color temperature of the lamp is readily increased and substantial improvement in color rendition is achieved without significant loss in efficacy or reduction in lamp life.

The circuit of the present invention is also useful for operating discharge lamps containing mixed metal vapors such as the above described lamp or other lamps in a manner to avoid color separation therein, in accordance with the method and principles disclosed in copending application Ser. No. 701.333 - Owen, filed June 30, 1976 and assigned to the same assignee as the present invention. The disclosure thereof in the said Owen application it accordingly also incorporated herein by reference.

The invention will be better understood from the following description taken in conjunction with the accompanying drawings, in which.

Figure 1:
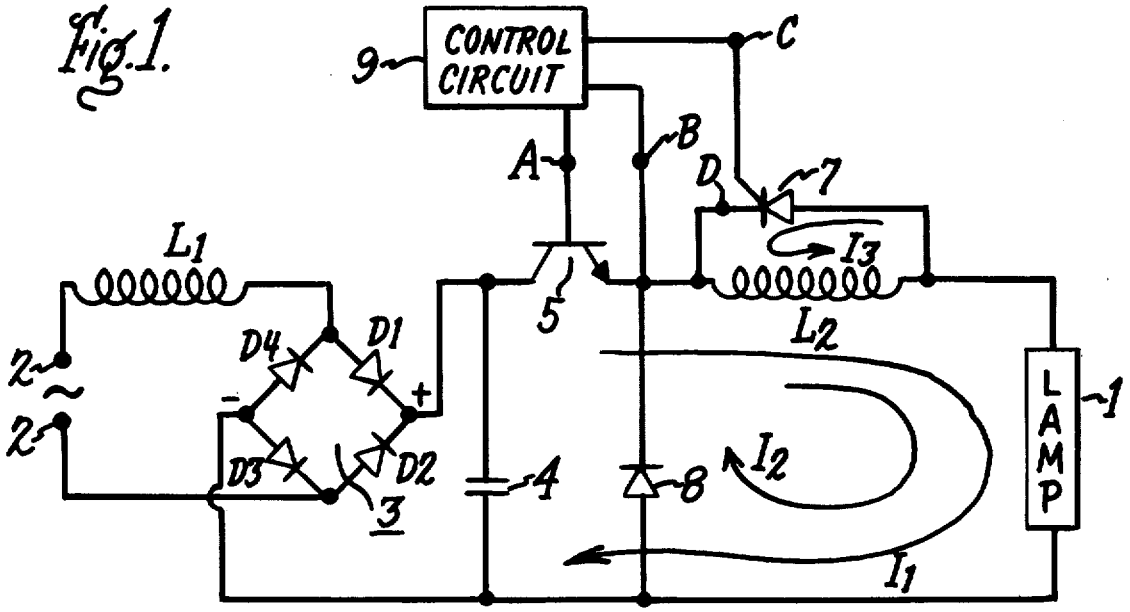
FIG. 1 is a circuit diagram of a lamp operating circuit showing one embodiment of the invention.

Referring now to the drawings, and particularly to FIG. 1, there is shown a circuit diagram illustrating an embodiment of the DC pulsing circuit of the invention for operating a gaseous discharge lamp 1, which is typically a high pressure sodium vapor lamp such as described above. The circuit comprises terminals 2 of a source of alternating current, and induction coil L1 connected at one side to one of the source terminals and at the other side to an input terminal of full wave bridge rectifier 3, which comprises diodes D1, D2, D3 and D4 arranged in conventional manner as shown, the other input terminal of rectifier 3 being connected to the other source terminal 2. Filter capacitor 4 connected across the DC supply circuit provides a filtered DC voltage supply for the pulsing circuit described hereinafter and increases the average voltage supplied thereto. Induction coil L1 serves to limit current to the lamp at the starting and warm-up stage.

The pulsing circuit illustrated in FIG. 1 comprises transistor switch 5, induction coil L2 and lamp 1 connected in series across filter capacitor 4, silicon controlled rectifier switch (SCR) 7 connected across induction coil L2, and coasting diode 8 connected across the serially connected induction coil L2 and lamp 1. Induction coil L2, lamp 1 and diode 8 thus form a discharge loop, with transistor switch 5 being connected between the DC supply source and this discharge loop. SCR switch 7 and transistor switch 5 are operated repetitively and sequentially by timing (control) circuit 9 connected to the gate electrode of SCR 7 and the base of transistor 5. Control circuit 9 is shown in detail in FIG. 4.

Figure 2:
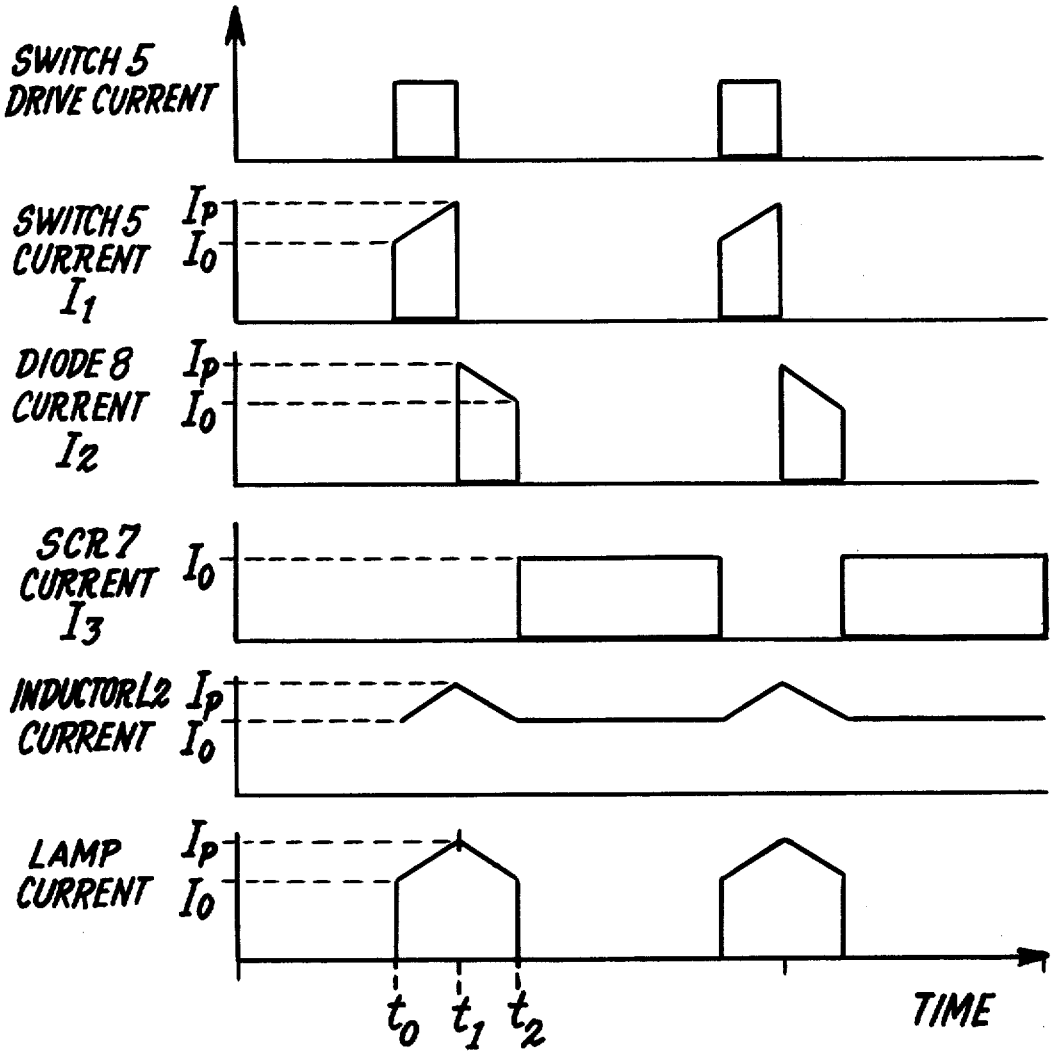
FIG. 2 shows a number of current waveforms relating to the operation of the FIG. 1 circuit.

In the operation of the described circuit, and assuming that lamp 1 is in steady state operation with SCR switch 7 turned on and switch 5 turned off, a current $I_3$ is flowing in the loop comprising SCR 7 and induction coil L2. With reference to FIG. 2, the instantaneous value of $I_3$ is designated as $I_o$. At this time only a small voltage appears across inductor L2. When transistor switch 5 closes at time $t_o$ by operation of control circuit 9, a substantially higher voltage appears across inductor L2 and results in commutation (turn-off) of SCR 7 and flow of current $I_1$ through the series circuit of switch 5, inductor L2, and lamp 1 back to the power source. Current $I_1$ then increases with a time constant L/R, where L is the inductance of L2 and R is the effective resistance of lamp 1. This current increases until switch 5 opens at time $t_1$ at which time it has a peak value $I_p$. At the same time, the voltage across inductor L2 reverses polarity, and current $I_2$ begins to flow through the loop comprising inductor L2, lamp 1, and coasting diode 8. As seen in FIG. 2 in the $I_2$ waveform, this current starts at $I_p$ and decays with the time constant L/R. Current $I_2$ continues to flow until it reaches a value of approximately $I_o$ at time $t_2$. Then SCR 7 is triggered on by control circuit 9 and current $I_2$ ceases, while current $I_3$ is initiated. This current decays with a time constant L/R' where R' is the resistance of SCR 7 and induction coil L2. Since R' is quite small, this time constant is quite long, and current $I_3$ does not decay appreciably. Current $I_3$ continues to flow until transistor switch 5 closes again, which begins a new cycle. As will be seen, with the three currents $I_1$, $I_2$ and $I_3$, there is continuous current flow through inductor L2 during an operating cycle.

A better understanding of the operation of the circuit will be obtained by a consideration of the energy flow and storage during various times of the described cycle. At the instant switch 5 closes (at time $t_o$), there is a current $I_1$ of value $I_o$ flowing in induction coil L2. This represents an amount of energy stored in the inductor of $E_1$ = one half $LI_o^2$. When switch 5 opens at time $t_1$, a current $I_1$ of value $I_p$ is flowing through inductor L2 representing a stored energy of $E_2$ = one half $LI_p^2$. Thus, the stored energy in the inductor has increased by $\Delta E$ = one half L $(I_p^2 - I_o^2)$ during this part of the cycle. In order to begin the next cycle with a current value of $I_o$, this energy, i.e., $\Delta E$, must be dissipated during the remainder of this cycle. This is accomplished in the following manner. When switch 5 opens current $I_2$ begins to flow, the energy stored in L2 is $E_2$. As the current through L2, lamp 1 and diode 8 decays to $I_o$, the energy $\Delta E$ is dissipated in the lamp. In accordance with the invention, it is only after this energy is dissipated in the lamp that SCR 7 is turned on (time $t_2$). If the SCR were turned on at time $t_1$ instead of $t_2$, or if a diode were used in place of the SCR, then energy $\Delta E$ would be dissipated in the SCR (or diode) and inductor L2. This would represent a power loss approximately equal to the lamp power, and would accordingly be undesirable. However, most of this increment of stored energy is dissipated in the lamp, thus providing a highly efficient lamp ballast system which results in a high level of lamp system efficacy (lumens per watt). While SCR 7 is on, very little energy is dissipated, since the current is decaying only slightly, as previously noted. Thus, there is a constant amount of stored energy $E_1$ in inductor L2 to which an increment $\Delta E$ is added in the time period $t_o - t_1$ and then subtracted in the time period $t_1 - t_2$ in each cycle. As a result, a waveform as depicted in FIG. 2 representing the lamp current is produced, characterized by a fast rise and fall. It has been found that such a waveform is particularly desirable in order to provide a substantial increase in color temperature of the gaseous discharge lamp in accordance with the principles disclosed in the aforementioned Osteen application. The means provided in accordance with the present invention for efficiently storing energy in the inductor as described above makes possible lamp current rise and fall times of the order of microseconds, corresponding to the switching speeds of transistor 5 and SCR 7.

As will be understood, the desired pulse repetition rate and duty cycle to obtain improved color properties of the lamp as disclosed in the aforementioned Osteen and Owen applications are with respect to the lamp current pulses, and control circuit 9 should accordingly be suitably adjusted to operate transistor switch 5 in such a manner as to provide the desired lamp current pulse repetition rate and duty cycle.

Figure 3:
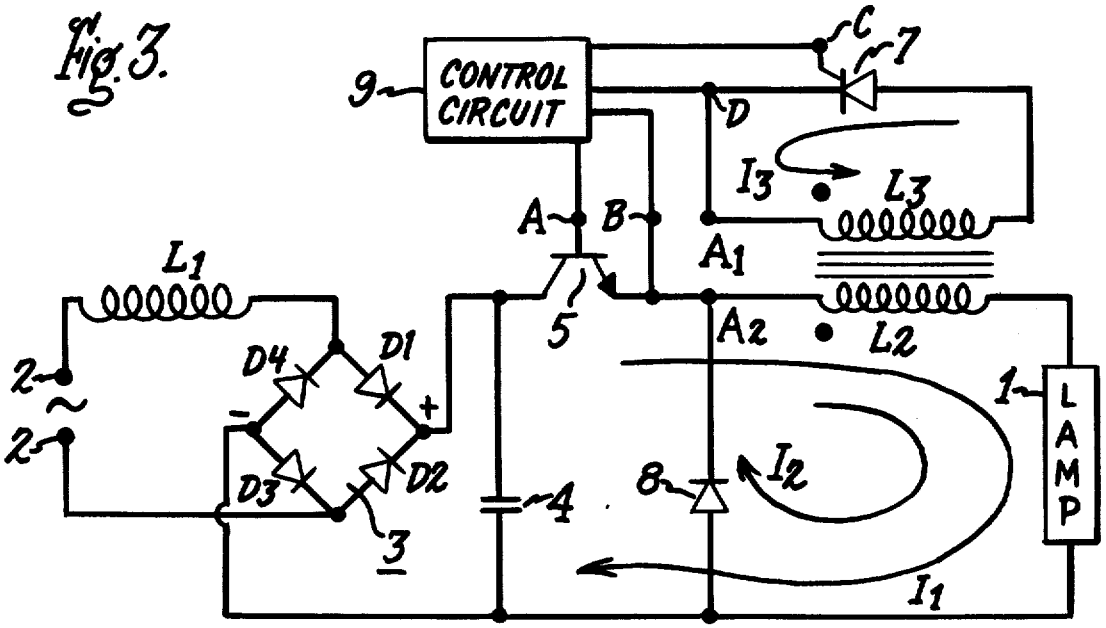
FIG. 3 is a circuit diagram of a modification of the FIG. 1 operating circuit.
Figure 4:
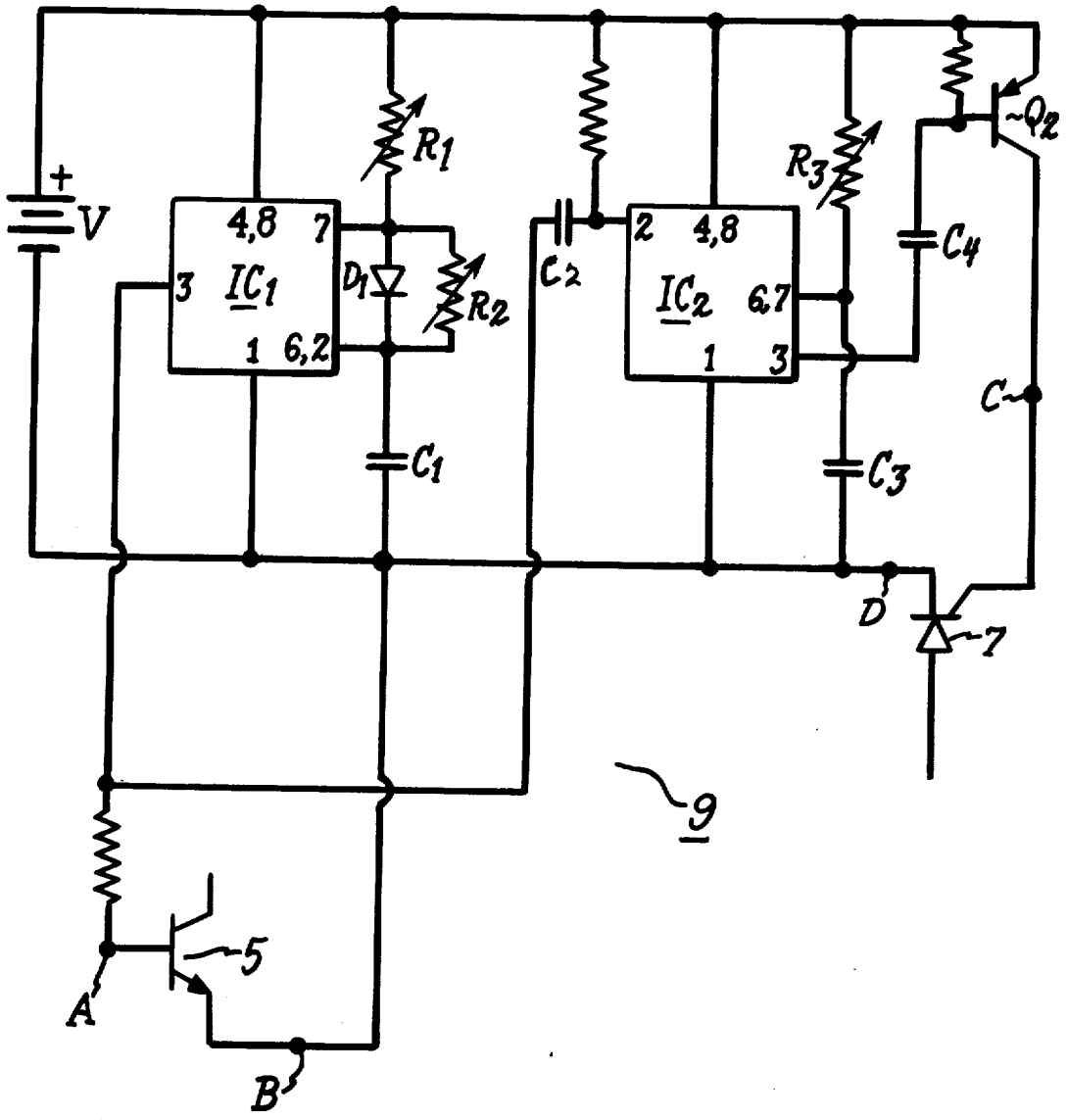
FIG. 4 is a circuit diagram of the control circuit shown in FIGS. 1 and 3.

FIG. 4 is a circuit diagram of control circuit 9 shown in FIGS. 1 and 3, wherein the control circuit has four output terminals A, B, C, D, with terminals A and B connected to transistor 5 respectively at the base and emitter thereof, and terminals C and D connected to SCR switch 7 respectively at the gate and cathode thereof. The function of control circuit 9 is to produce a base drive current in transistor 5 for closing that switch and to remove the base drive current to open the switch, the base drive being produced between terminals A and B. In addition, the control circuit produces a pulse of current at a sufficient voltage to trigger SCR 7 into conductive state, this pulse being produced between terminals C and D. For a pulse repetition rate of 1 kHz, a typical timing for operation of transistor 5 and SCR 7 (see FIG. 2) when $t_o = 0$ would be $t_1 = 100$ microseconds and $t_2 = 200$ microseconds.

The control circuit shown in FIG. 4 comprises two timing networks each consisting of a 555 type integrated circuit and associated circuitry. The integrated circuits, shown as $IC_1$ and $IC_2$, may be obtained commercially as type NE555 from Signetics Corporation.

The pins indicated for the illustrated IC circuits have the following functions: pin 1 is the power supply common (negative) voltage, pin 2 is the trigger input, pin 3 is the output voltage, pin 4 is the reset input, pin 6 is the threshold input, pin 7 is the discharge output, and pin 8 is the positive power supply input. The IC consists of a bistable circuit whose output voltage is either high (near positive power supply voltage) or low (near common or negative power supply voltage). The circuit is triggered into the high state when the voltage at trigger pin 2 goes below 1/3 V, where V is the power supply voltage. The circuit is triggered into the low state when the voltage at the threshold pin 6 goes above 2/3 V. The discharge pin 7 exhibits a short circuit to power supply common (pin 1) when the circuit is in the low state.

The timing network associated with $IC_1$ forms an astable multivibrator, whose output voltage has a waveform substantially like the base drive current waveform for switch 5 as shown in FIG. 2. It will be noted that pins 2 and 6 are both connected to timing capacitor $C_1$. Thus, when the voltage on $C_1$ goes higher than 2/3 V, threshold input pin 6 will cause the output voltage (pin 3) to go low and the discharge output (pin 7) shorts to pin 1. When the voltage on $C_1$ goes below 1/3 V, the trigger input (pin 2) will cause the output voltage to go high, and the short between the discharge output and pin 1 is removed, i.e., the discharge output is turned off. In the operation of this circuit, assuming that the voltage on capacitor $C_1$ has dropped to 1/3 V, the output voltage at pin 3 is then high, and the discharge output (pin 7) is turned off. Then $C_1$ will charge through variable resistor $R_1$ and diode $D_1$ with a time constant $R_1C_1$. When the voltage on $C_1$ reaches 2/3 V, the output voltage will go low, and pin 7 is shorted to pin 1, resulting in discharge of capacitor $C_1$ through variable resistor $R_2$ and pins 7 and 1 with a time constant $R_2C_1$. When the voltage on $C_1$ reaches 1/3 V, the cycle begins again.

The timing network associated with $IC_2$ forms a monostable multivibrator. When the output voltage of $IC_1$ (pin 3) goes low, a negative pulse is applied through capacitor $C_2$ to the trigger input (pin 2) of $IC_2$. This causes the output of $IC_2$ to go high and pin 7 to turn off. Then capacitor $C_3$ begins charging from zero volts through resistor $R_3$ with a time constant $R_3C_3$. When the voltage on $C_3$ reaches 2/3 V, the output voltage goes low, and $C_3$ discharges through pins 7 and 1. The output then remains low until another trigger pulse is received from $IC_1$. The output pulse is then differentiated by capacitor $C_4$ and the negative transistion of this output pulse is amplified and inverted by transistor. $Q_2$. This pulse is applied to the gate of SCR 7, as shown in FIG. 4, to turn on the SCR.

The timing operation in terms of the waveforms shown in FIG. 2 is such that at time $t_o$, $IC_1$ goes high, turning on transistor switch 5. At time $t_1$, $IC_1$ goes low, turning off switch 5 and triggering $IC_2$. At time $t_2$, $IC_2$ turns off (goes low), causing SCR switch 7 to be triggered on. A broad pulse is produced by $IC_1$ between time $t_o$ and time $t_1$, such as shown characterizing the switch drive current in FIG. 2, and a narrow pulse (not shown) is produced by the action of $IC_2$ at time $t_2$ to gate the SCR on. After some time delay, $IC_1$ again goes high, thus beginning a new cycle.

FIG. 3 shows a modification of the FIG. 1 circuit wherein a secondary induction coil winding L3 is magnetically coupled to inductor L2, and SCR 7 is connected across inductor L3, forming a loop in which current $I_3$ flows. The operation of this circuit is otherwise essentially the same as that described in connection with the FIG. 1 embodiment. By virtue of the modified arrangement, the SCR switch 7 is isolated from the power circuit while being magnetically coupled to inductor L2, and this permits a choice of the voltage and current ratings of the SCR.

Terminal $A_1$ of the SCR 7-L3 loop in FIG. 3 may be connected, if desired, to terminal $A_2$ or other point on the power circuit for purposes of simplifying the control circuit connections, or for other reasons.

In a typical circuit such as those illustrated, inductor L1 would have an inductance of 100 millihenries, inductor L2 an inductance of 7 millihenries, the turns ratio of L3 to L2 would be 1.5 to 1, and lamp 1 would be a 150 watt high pressure sodium vapor lamp as described hereinbefore.

While an independent DC voltage supply V, which may typically be about 15 volts, is shown connected to the control circuit in FIG. 4, it will be understood that, if desired, the control circuit may be connected to the DC supply of the power circuit, with the provision of suitable means for reducing the voltage.

While particular types of controlled switches 5 and 7 are shown and described, it will be understood that other types of controlled switches may be employed for either or both of these components, as appropriate.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. A lamp operating circuit comprising. in combination, a direct current power source, first controlled switch means and inductance means connected in series across said power source, means for serially connecting a gaseous discharge lamp to said first controlled switch means and said inductance means, unidirectional conducting means connected across said series connected inductance means and said lamp connecting means, second controlled switch means coupled to said inductance means for stopping current flow to the gaseous discharge lamp and for storing magnetic energy in said inductance means while said controlled switch means is on, and control means coupled to said first and second controlled switch means for repetitively and sequentially operating the same at predetermined intervals, whereby DC pulses may be applied to the gaseous discharge lamp for operation thereof.

2. A circuit as defined in claim 1, said inductance means and said unidirectional conducting means comprising with the lamp a discharge loop, said first controlled switch means connected between said power source and said discharge loop.

3. A circuit as defined in claim 2, said inductance means comprising an induction coil connected in series between said first controlled switch means and said lamp connecting means, said second controlled switch means connected across said induction coil.

4. A circuit as defined in claim 2, said inductance means comprising a primary winding connected in series between said first controlled switch means and said lamp connecting means and a secondary winding magnetically coupled to said primary winding, said second controlled switch means connected across said secondary winding.

5. A circuit as defined in claim 1, said first controlled switch means comprising a transistor having a base electrode, said second controlled switch means comprising a unidirectional controlled switch having a gate electrode, said control means connected to said base electrode and said gate electrode.

6. A circuit as defined in claim 5, said unidirectional controlled switch comprising a silicon controlled rectifier.

7. A circuit as defined in claim 1, said control means having timing network means comprising first and second multivibrator circuits connected respectively to said first and second controlled switch means, said first multivibrator circuit connected to said second multivibrator circuit for controlling the operation thereof.

8. A circuit as defined in claim 7, said first multivibrator circuit comprising an astable multivibrator circuit and said second multivibrator circuit comprising a monostable multivibrator circuit.

9. A circuit as defined in claim 1, said unidirectional conducting means comprising a diode.

10. A lamp operating circuit comprising, in combination, a direct current power source, first controlled switch means, inductance means and a gaseous discharge lamp connected in series across said power source, unidirectional conducting means connected across said series connected inductance means and said gaseous discharge lamp, second controlled switch means coupled to said inductance means for stopping current flow to said gaseous discharge lamp and for storing magnetic energy in said inductance means while said second controlled switch means in on, and control means coupled to said first and second controlled swich means for repetitively and sequentially operating the same at predetermined intervals, whereby DC pulses are applied to said gaseous discharge lamp for operation thereof.

11. A circuit as defined in claim 10, said gaseous discharge lamp comprising mixed metal vapors.

12. A circuit as defined in claim 10, wherein said gaseous discharge lamp is a high pressure sodium vapor lamp.

13. A circuit as defined in claim 12, said inductance means, said lamp, said unidirectional conducting means comprising a discharge loop, said first controlled switch means connected between said power source and said discharge loop.

14. A circuit as defined in claim 13, said first controlled switch means comprising a transistor switch, said second controlled switch means comprising a silicon controlled rectifier.

15. A circuit as defined in claim 13, said inductance means comprising an induction coil connected in series between said first controlled switch means and said lamp, said second controlled switch means connected across said induction coil.

16. A circuit as defined in claim 13, said inductance means comprising a primary winding connected in series between said first controlled switch means and said lamp, and a second winding magnetically coupled to said primary winding, said second controlled switch means connected across said secondary winding.

* * * * *